US005644379A

United States Patent [19]

Chin et al.

[11] Patent Number: 5,644,379

[45] Date of Patent: Jul. 1, 1997

[54] PASSIVE BELT GUIDANCE BY FABRIC WEAVE ORIENTATION

[75] Inventors: Leo Chin, Bronx; Abu S. Islam, Mt. Vernon, both of N.Y.; Sandra Graveson, Waterbury, Conn.; Robert J. Kleckner, Yorktown Heights, N.Y.

[73] Assignee: Xerox Corporation, Stamford, Conn.

[21] Appl. No.: 548,566

[22] Filed: Oct. 26, 1995

[51] Int. Cl.[6] ..... G03B 27/32

[52] U.S. Cl. ..... 355/27; 198/846

[58] Field of Search ..... 355/27, 212, 312; 198/840, 842, 846, 847; 428/225

[56] References Cited

U.S. PATENT DOCUMENTS

| | | | |
|---|---|---|---|
| 3,642,119 | 2/1972 | Warwick | 198/840 |
| 4,061,222 | 12/1977 | Rushing | 198/807 |
| 4,170,175 | 10/1979 | Conlon, Jr. | 101/1 |
| 4,174,171 | 11/1979 | Hamaker et al. | 355/3 BE |
| 4,344,693 | 8/1982 | Hamaker | 355/3 BE |
| 4,572,417 | 2/1986 | Joseph et al. | 226/20 |
| 4,961,089 | 10/1990 | Jamzadeh | 355/207 |
| 5,078,263 | 1/1992 | Thompson et al. | 198/807 |
| 5,158,171 | 10/1992 | Gratt | 198/842 Y |
| 5,383,006 | 1/1995 | Castelli | 355/212 |
| 5,411,825 | 5/1995 | Tam | 219/216 Y |

*Primary Examiner*—Joan H. Pendegrass
*Attorney, Agent, or Firm*—Kevin R. Kepner

[57] ABSTRACT

An apparatus and technique to guide a fabric conveyor belt by alignment of the fabric weaves with a mating fabric on a vacuum platen is described. The technique functions in a manner similar to an edge guide, however the correcting forces are applied over the surface of the belt as opposed to the edge of the belt. Robust tracking can be achieved and the need for frequent adjustments of the conveyor rollers by the user is eliminated.

4 Claims, 3 Drawing Sheets

PASSIVE BELT GUIDANCE BY FABRIC WEAVE ORIENTATION

The present invention relates to a technique and apparatus for developing digital film, and specifically, to a technique to guide a fabric conveyor belt by alignment of the fabric weaves with a mating fabric on a vacuum platen.

In conventional digital film processing apparatuses, the film is first made sensitive to light by electrostatically charging the film. A latent image is then formed on the film by exposing the film to light from a modulated laser or similar device. The exposed film is developed by applying heat to the film.

In a first conventional film processing apparatus, a heated metal plate is provided for heating the film. The film is manually applied directly to the surface of the heated plate. The operator then manually counts a period of time, after which the film is removed from the surface of the plate. Since this arrangement requires extensive manual activity, productivity is low and film developing costs are high.

In a second conventional film processing apparatus, heating is accomplished by providing at least one heated roller between input and exit pinch rollers. The pinch rollers serve to feed the film past the heated roller while maintaining tension on the film to assure good contact with the heated roller. The film is heated by conduction through contact with the heated roller.

However, with the second arrangement, several problems arise. First, the leading and trailing edges of the film may be incompletely or poorly developed. This occurs because the leading and trailing edges are not under tension when they pass over the heated roller. As a result, sufficient contact between these edges of the film and the heated roller is not achieved.

In addition, the side edges of the film may also be poorly or incompletely developed. This is because the ends of the heated roller, which are mechanically coupled to other portions of the processing apparatus (e.g. the bearings, frame, etc.), act as heat sinks. Consequently, the temperature at the ends of the heated roller may be insufficient to properly develop the latent image at the side edges of the film. While the heated roller may be lengthened in order to provide a more uniform temperature distribution along that portion of the heated roller in contact with the film, this has the undesirable consequences of increasing both manufacturing costs and the size of the footprint of the film processing apparatus.

Moreover, during the film heating process, emulsion of the film softens and must be cooled prior to being mechanically contacted. Unless an external cooling device is provided for cooling the film prior to contact with the exit pinch rollers, the exit pinch rollers must be positioned sufficiently far down stream of the heated roller in order to permit the film to be cooled by natural convection. As a consequence, film is wasted on the leading and trailing edges.

Further, heat-developing film generally includes a polyester base which may permanently deform when heated under tension. In addition, if the film is not sufficiently cooled prior to entering the exit roller nip, further cooling occurring while the film is constrained in the nip can lead to the formation of ripples or other undesirable deformations of the film.

In a third conventional film heating apparatus, described in co-pending U.S. patent application No. 08/434,960, (Oliff & Berridge Attorney Docket No. JAO 34080, Xerox Attorney Docket No. D/95134), commonly assigned to the assignee herein, a means for supporting film and a heating device for developing the film without contacting the film is described. The device has the advantage of edge-to-edge film development, however the device may produce undesirable ripples in the film if the development temperature requirement is high.

A fourth film heating apparatus, described in a co-pending application U.S. patent application No. 08/549,293, filed on even date herewith, Attorney Docket No. D/95470, commonly assigned to the assignee herein, titled "Constrained Film Heat Processor and Method of Developing Digital Film by Radiant Heat Transfer", the film is constrained by a vacuum platen and heated by radiant heaters. The referenced device can produce high quality, developed film.

A fifth film heating apparatus, described in a co-pending application U.S. patent application No. 08/548,628, Attorney Docket No. D/95468, commonly assigned to the assignee herein, titled "Constrained Film Heat Processor and Method of Developing Digital Film by Conduction Heat Transfer", presents a means for developing digital film that is dimensionally stable.

It is common to use a conveyor belt to transport materials during, or to and from, processing. Belt guidance is a common problem that arises when using conveyor belt transports. If unguided, the conveyor belt will preferentially walk over the surface of the rollers. If the walk is left unchecked, it will progress until the belt walks off the edge of a roller and the system fails.

Several techniques are used to compensate for belt walk. They may be broadly categorized into "active" and "passive" methods of belt guidance.

The active techniques involve sensing of the belt position then commanding an activator to compensate for the walking motion. These techniques provide perhaps the most accurate control of belt motion. However, They can be expensive to implement and may be sensitive to contamination. The passive belt guidance techniques are more prevalent in industry. Here, mechanical means are used to guide the belt without directly sensing the belt position. For example, an edge guide is strategically placed to apply a lateral force on the belt and limit its walking motion. The edge guide could be placed on a roller end, or at some point in a span between rollers. Edge guides are simple to design and implement. They may be rigid or spring loaded. Their main drawback is that they apply the guiding force at the weakest point of the belt—along its edge. Belt edge wear is a common mode of failure with these devices.

The invention described herein aims to eliminate the problems that are described above when belts are used in systems that involve vacuum platens such as those referenced above.

The following disclosures may be relevant to various aspects of the present invention:

U.S. Pat. No. 4,061,222

Inventor: Rushing

Issue Date: Dec. 6, 1977

U.S. Pat. No. 4,572,417

Inventor: Joseph et al.

Issue Date: Feb. 25, 1986

U.S. Pat. No. 4,170,175

Inventor: Conlon, Jr.

Issue Date: Oct. 9, 1979

U.S. Pat. No. 4,174,171

Inventor: Hamaker et al.

Issue Date: Nov. 13, 1979

U.S. Pat. No. 4,344,693

Inventor: Hamaker

Issue Date: Aug. 17, 1982

U.S. Pat. No. 4,961,089

Inventor: Jamzadeh

Issue Date: Oct. 2, 1990

U.S. Pat. No. 5,078,263

Inventor: Thompson et al.

Issue Date: Jan. 7, 1992

U.S. Pat. No. 5,383,006

Inventor: Castelli

Issue Date: Jan. 17, 1995

The relevant portions of the foregoing disclosures may be briefly summarized as follows:

U.S. Pat. No. 4,061,222 to Rushing discloses an apparatus for tracking an endless belt along an endless path by a tiltable belt steering roller whose position is continually adjusted so that the belt is maintained at a stable equilibrium position despite changes in the belt shape. The adjustment is determined by control circuitry which produces signals representative of lateral belt edge position, a desired belt edge position, and either a steering roller position or an instantaneous lateral belt deviation rate to produce a control signal which is applied to a gear motor to control the tilt angle of the steering belt roller. This apparatus utilizes the active guidance method.

U.S. Pat. No. 4,572,417 to Joseph et al. discloses an apparatus for controlling lateral, cross track alignment of a web moving along a path to minimize lateral deviation between successive discrete areas of the web. A steering roller supports the web for movement along the path and is rotatable about an axis perpendicular to a plane of the span of the web approaching the steering roller.

U.S. Pat. No. 4,170,175 to Conlon, Jr. discloses a system for tracking an endless belt which automatically compensates for creep of the belt. The belt is supported by four rollers. A first is a drive roller, a second and third are idler rollers, and a fourth roller is an idler roller with flared ends. The flared roller provides passive tracking without electronic or active feedback. One of the idler rollers is spring loaded such that when an edge of the belt creeps up on one of the flared ends of the fourth roller, that side of the spring loaded roller is caused to tilt due to increased belt stiffness on that side. This positions the belt laterally toward a central position.

U.S. Pat. No. 4,174,171 to Hamaker et ano. disclose an apparatus for controlling the lateral alignment of a moving photoconductive belt. A resilient support constrains lateral movement of the belt causing a moment to be applied to a pivotably mounted steering post. As a result, the steering post pivots in a direction to restore the belt along a predetermined path. This apparatus is passive and provides no active electronic feedback.

U.S. Pat. No. 4,344,693 to Hamaker disclose an apparatus for controlling the lateral alignment of a moving photoconductive belt. Lateral movement of the belt causes a frictional force to be applied to the belt support. The frictional force tilts the belt support to restore the belt to the predetermined path of movement. This apparatus is passive and provides no active electronic feedback.

U.S. Pat. No. 4,961,089 to Jamzadeh discloses a method and apparatus for controlling lateral movement of a web along an endless path. The lateral position of the web is monitored and a determination is made by a control unit if the web is within predetermined limits such that a copying operation can be completed while the web is still properly tracking. If the web is not tracking properly, or if it is predicted that the web will track beyond its predetermined lateral limits within a copying operation, a correcting step is taken prior to the copying operation. The correcting step determines a tilt angle for a steering roller. Upon completion of the correcting step, the apparatus returns to a monitoring capacity and does not provide corrective measures until the web is beyond or is predicted to go beyond the predetermined limits during a subsequent copying operation. This insures that copying operations have proper registration and do not include corrective steps during the copying operation which might interfere with the registration. This apparatus uses an active scheme to determine corrective action.

U.S. Pat. No. 5,078,263 to Thompson et al. discloses an active steering method that introduces corrective skew through a small rotation about the "soft-axis" of one or more idler rolls. The skew is introduced by an external connection to a servo-motor to alter the angle at whirl the web enters or leaves the roll to cause the web to walk along the roll.

U.S. Pat. No. 5,383,006 to Castelli describes an apparatus for guiding a moving belt, particularly in an electrophotographic printing machine of the type having an endless photoreceptor belt supported by a plurality of rolls and arranged to move in a predetermined path through a plurality of processing stations disposed therealong the belt being of the type which is supported by a plurality of rolls. A compliant belt guide is positioned at each end of a tensioning roll. The guide is biased so as to absorb a portion of the force exerted on it by the moving belt but to maintain a minimal belt walk in a direction transverse to the predetermined path.

In accordance with one aspect of the present invention, there is provided an apparatus for processing film. The apparatus comprises a film support and constraining device, the support and constraining device comprising a fabric portion in contact with the film, wherein the fabric portion and the film have alignment channels formed therein in the process direction to maintain the film along the predetermined path.

Pursuant to another aspect of the present invention, there is provided an apparatus-for guiding a web along a predetermined path in a process direction. The apparatus comprises a web support and constraining device, the support and constraining device comprising a fabric portion in contact with the web, wherein the fabric portion and the web have alignment channels formed therein in the process direction to maintain the web along the predetermined path.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
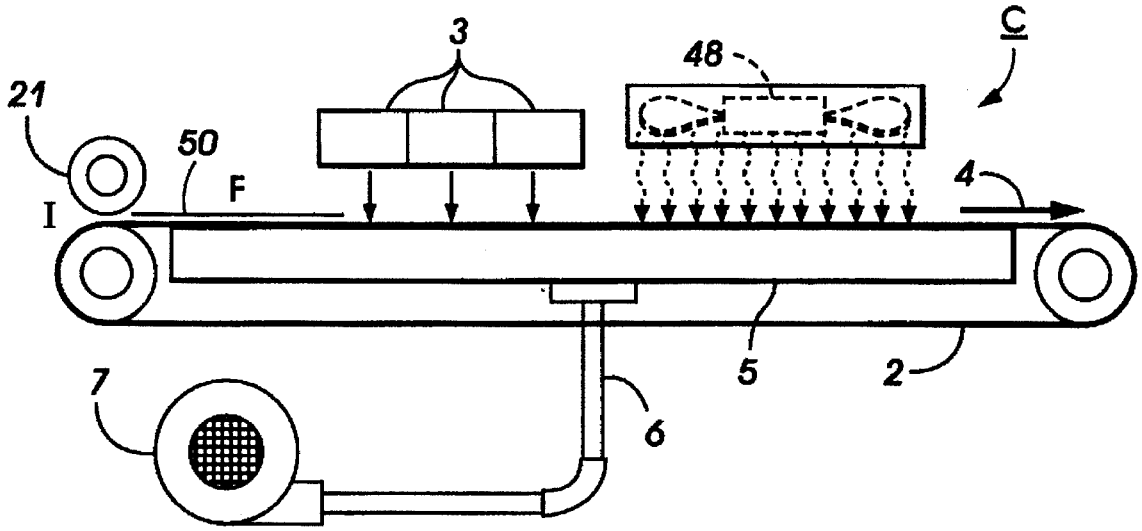
FIG. 1 is a schematic view of a film heat processor using the FIG. 2 device.

FIG. 1 is a schematic view of film heat processor according to the first embodiment of the invention. The film heat processor 1 includes a continuous transport 2, such as an endless belt conveyor, for receiving a heat-developing film 50 at input I, a vacuum platen 5, the pump or blower 7 for creating a vacuum and the means for applying the vacuum to the vacuum platen 6. The film 50 may either be manually loaded onto the continuous transport 2 or directly supplied thereto from a well known film exposure device, such as an imagesetter. The film may be, by way of example, a migration imaging film that can be developed using radiant energy.

The continuous transport 2 conveys the film in the direction shown by arrow 4 past heaters 3 for developing. The heaters 3 are configured so that the film temperature is spatially constant along a direction perpendicular to the direction of movement of the film 50.

Film 50 is placed upon the conveyor belt 2 at the input section of the device I. The movement of the conveyor brings the film over the vacuum platen, where both the belt and the film become flattened against the platen surface. While in this flat shape, the film is further transported to and through the heater section. Here, the film is heated while it is constrained due to the action of the vacuum platen. The heated film 50 then exits the heater section. Upon its exit from the heater, the film enters a cooling zone C. The film 50 is cooled, by natural or forced convection and the conduction of heat through the surface of the vacuum platen. A cooling fan 48 is shown for illustration. Once cooled, the film 50 moves to the output section O. The film 50 may then be manually retrieved or delivered to an output tray (not shown).

Although the film processor 1 is shown as having a conveying surface appropriately sized to the width of a single sheet of film, it is understood that the width of the conveying surface may be increased in order to permit a plurality of films to be simultaneously developed.

Film processor 1 may include a soft, or resiliently compliant, pinch roller 21 for forming a nip with the continuous transport 2, and thus aiding in the loading of film 50.

When the film heat processor 1 is combined with an exposure device, it may either be connected externally to the exposure device or be formed as an integral part of the exposure device as a single unit construction. A film buffer may be provided between the exposure device and the film processor in order to permit temporary accumulation of the film prior to developing. In addition, the continuous transport 2 is preferably driven with a speed at least as great as the speed at which the film travels through the exposure device in order to enhance productivity.

The film heat processor shown in FIG. 1 can be made to operate in several modes. The first mode involves continuous motion of the conveyor belt.

In a second mode, the belt moves incrementally. This mode of operation will now be described. Film 50 is applied to the belt surface while the belt 2 is stationary and the vacuum pump 7 is off. The film 50 is then moved, by the conveyor motion, under the plurality of heaters 3 and the vacuum is applied. The film 50 is stationary while heated. Once sufficiently heated the belt 2 and film 50 is moved to the cooling station C. Once cooled, the film 50 is then output from the machine at the output station O. This incremental mode of operation has the advantage that it reduces power consumption and it reduces belt 2 and platen 5 wear. Wear is reduced because the vacuum is off during the part of the operational cycle when the belt 2 is moved relative to the platen 5.

One skilled in the art might envision several other modes of operation for the film processor of FIG. 1. This invention proposal therefore describes, but is limited to, the two modes of operation described above.

Figure 2:
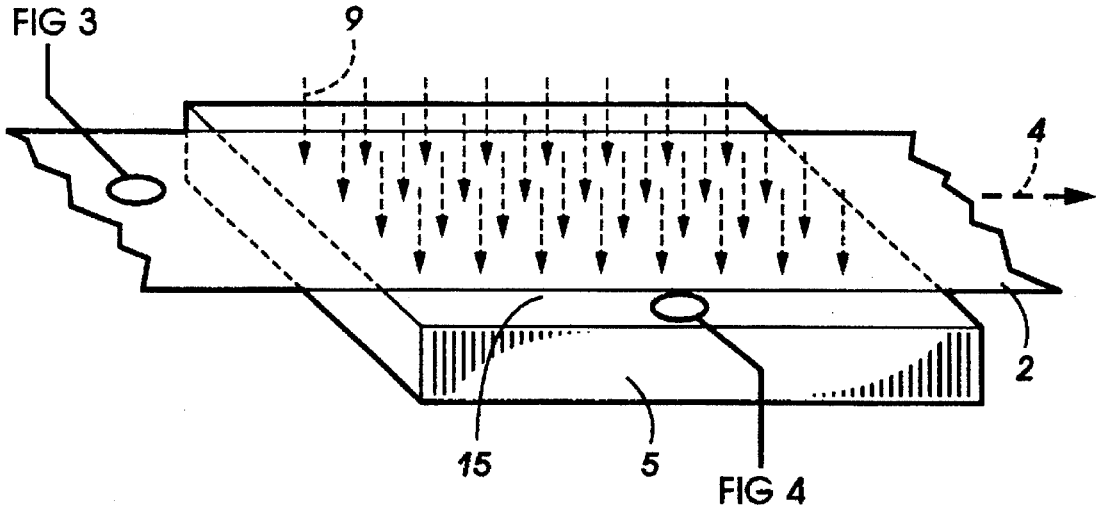
FIG. 2 is a perspective view of a vacuum platen and belt using the invention herein.

FIG. 2 illustrates a vacuum platen 5 in which the film and the platen move relative to each other. The film is placed on the surface of a conveyor belt 2 with its emulsion side up. The conveyor belt 2 must be porous, thermally insulating and smooth, so as to prevent embossing of the film when heated under vacuum. Suitable materials for construction of such a belt are Teflon® coated fiberglass weave materials. Beneath the conveyor belt 2 is a layer of vacuum diffusion material 34 that is porous, thermally stable, wear resistant, slippery and thermally insulating. Teflon® coated fiberglass weave materials are suitable example materials for such use.

FIG. 2 shows a conveyor belt 2 moving in the direction of arrow 4 as it passes over a stationary vacuum platen 5. The vacuum causes a normal force between the belt 2 and the vacuum platen 5 as indicated by the arrows 9. The normal force is supported by the surface of the belt and the surface of the platen.

Figure 3:
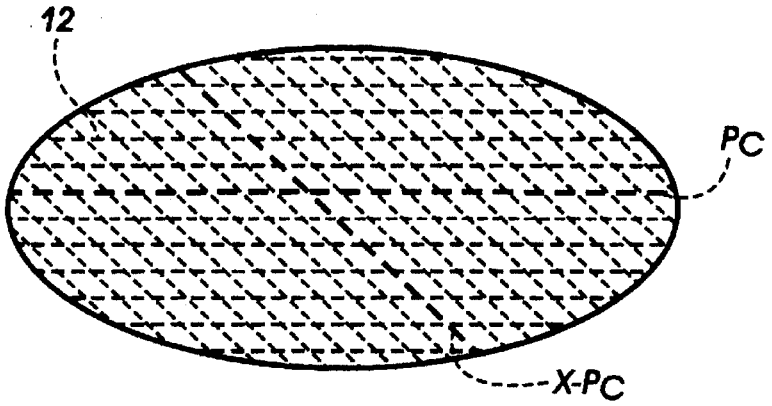
FIG. 3 is a detailed partial view of a portion of the belt herein.
Figure 4:
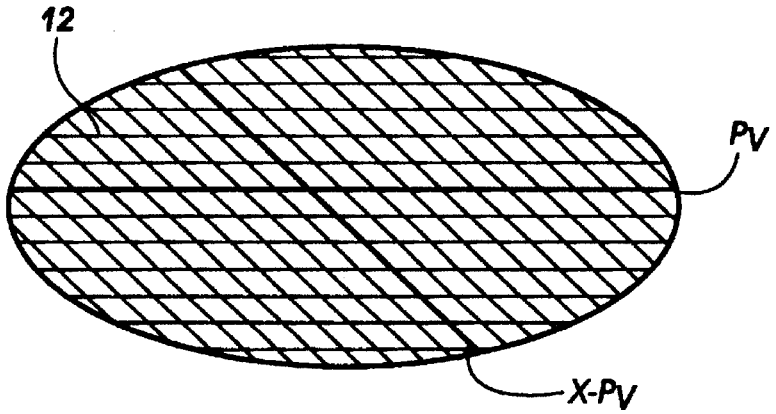
FIG. 4 is a detailed partial view of a portion of the platen fabric herein.

FIG. 3 and FIG. 4 show the details of the load supporting surfaces of the belt and the platen.

The conveyor belt 2 is made from an engineered fabric. The weave of the fabric has two predominant directions, shown by the dark solid lines in FIG. 3. One weave direction is parallel to the process direction of the conveyor belt, as indicated by the symbol Pc in FIG. 3. The second direction is perpendicular to the process direction, as indicated by the symbol X-Pc in FIG. 3.

The surface of the vacuum platen, FIG. 4, is also made from an engineered fabric. The weave of the vacuum platen fabric has two predominant directions as shown by the dark dashed lines in FIG. 4. One direction is parallel, or nearly parallel, to the process direction of the conveyor belt, as indicated by the symbol Pv in FIG. 4. The second direction is perpendicular to Pv, as indicated by the symbol X-Pv in FIG. 4.

Figure 5:
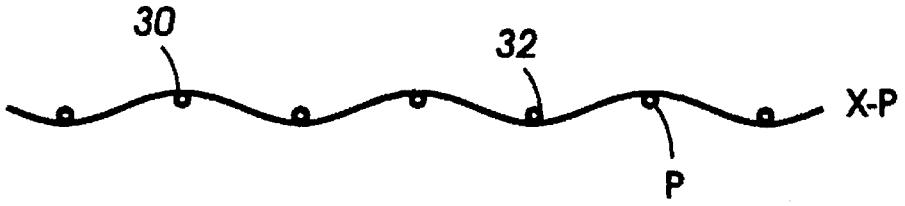
FIG. 5 is a cross sectional view of the belt used in the present invention.

FIG. 5 shows a cross section through the fabric. This figure is representative of either the conveyor belt fabric 12 or the vacuum platen fabric 15. FIG. 5 shows that the cross process fibers form hills 30 and troughs 32 in this view.

Figure 6:
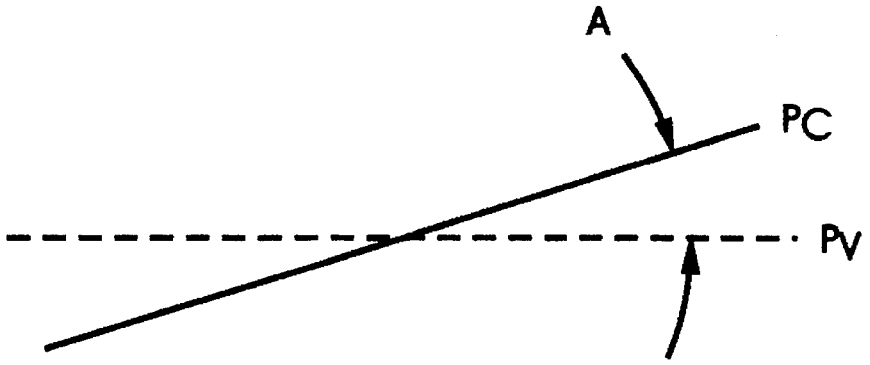
FIG. 6 is a first schematic diagram illustrating a misalignment of the fibers between the belt and the platen fabric.

When the conveyor belt fabric 12 moves over the surface of the vacuum platen fabric 15, the weaves in each fabric will form an angle. The angle, A, is indicated in FIG. 6.

If the angle A is chosen to be large, for example 45 degrees, the conveyor and the vacuum platen weaves simply move over each other. This motion does not create any substantial lateral force on the belt 2.

Figure 7:
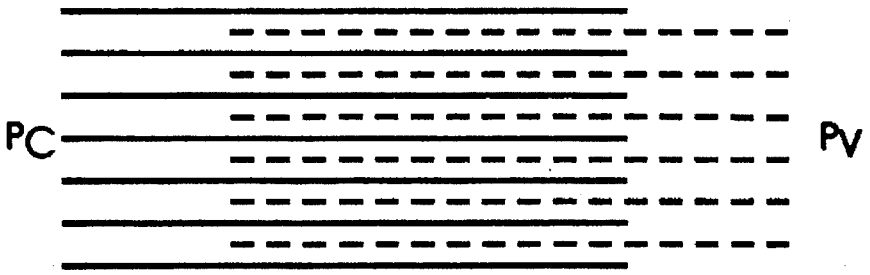
FIG. 7 is a second schematic diagram illustrating an alignment of the fibers between the belt and the platen fabric.

If the angle A is chosen to be small, for example 15 degrees, the normal force caused by the vacuum will cause the hills 30 of one fabric to align with the troughs 32 in the other. This alignment is illustrated in FIG. 7. Once this alignment has been achieved, a significant lateral force can be sustained by the conveyor belt 2 without lateral motion. Thus by proper alignment of one fabric weave with the other, the conveyor belt 2 can be guided much in the same manner as an edge guide. However, in this case the lateral force is applied to the entire surface of the belt 2 that is in contact with the mating fabric surface weave 15. Whereas with an edge guide, the lateral force is only applied to the edge of the belt, which is very weak.

By using this approach the belt can be made to track straight, without the use of edge guides. Further, the conveyor belt rollers would not require the frequent adjustment that is currently required on conveyor systems that do not use any other form of belt guidance. Additionally, while illustrated using a woven fabric belt, it is also possible to using a nonwoven material having linear channels formed therein.

While this invention has been described in conjunction with specific embodiments thereof, it is evident that many alternatives, modification and variations will be apparent to those skilled in the art. Accordingly, the preferred embodiments of the invention as set forth herein are intended to be illustrative, not limiting.

In recapitulation, there is provided an apparatus and technique to guide a fabric conveyor belt by alignment of the fabric weaves with a mating fabric on a vacuum platen is described. The technique functions in a manner similar to an edge guide, however the correcting forces are applied over the surface of the belt as opposed to the edge of the belt. Robust tracking can be achieved and the need for frequent adjustments of the conveyor rollers by the user is eliminated.

It is, therefore, apparent that there has been provided in accordance with the present invention, an apparatus and technique to guide a fabric conveyor belt that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for for guiding a web along a predetermined path in a process direction, comprising a web support and constraining device, said support and constraining device comprising a fabric portion in contact with the web, wherein said fabric portion and the web have alignment channels formed therein in the process direction to maintain the web along the predetermined path.

2. An apparatus according to claim 1, wherein said web support and constraining device further comprises a vacuum plenum to draw the web into close contact with said fabric portion.

3. An apparatus according to claim 2, wherein said fabric portion comprises a woven fabric having a portion of the weave aligned in the process direction so as to form a series of troughs substantially aligned in the process direction.

4. An apparatus according to claim 3, wherein the web comprises a woven fabric having a portion of the weave aligned in the process direction so as to form a series of troughs substantially aligned in the process direction.

* * * * *